US008869571B2

(12) United States Patent
Pedersen

(10) Patent No.: US 8,869,571 B2
(45) **Date of Patent: *Oct. 28, 2014**

(54) APPARATUS FOR PROCESSING FUR

(75) Inventor: Kurt Pedersen, Vinderup (DK)

(73) Assignee: Jasopels A/S (DK)

( * ) Notice: Subject to any disclaimer, the term of this patent is extended or adjusted under 35 U.S.C. 154(b) by 0 days.

This patent is subject to a terminal disclaimer.

(21) Appl. No.: 13/816,915

(22) PCT Filed: Aug. 4, 2011

(86) PCT No.: PCT/DK2011/000089

§ 371 (c)(1),
(2), (4) Date: Feb. 13, 2013

(87) PCT Pub. No.: WO2012/019606

PCT Pub. Date: Feb. 16, 2012

(65) Prior Publication Data

US 2013/0139559 A1 Jun. 6, 2013

(30) Foreign Application Priority Data

Aug. 13, 2010 (DK) ..... 2010 00716
Mar. 21, 2011 (DK) ..... 2011 00055 U

(51) Int. Cl.
*C14B 1/10* (2006.01)
*C14B 17/02* (2006.01)
*C14B 1/02* (2006.01)
*C14B 15/00* (2006.01)

(52) U.S. Cl.
CPC . *C14B 1/10* (2013.01); *C14B 17/02* (2013.01); *C14B 1/02* (2013.01); *C14B 15/00* (2013.01)
USPC ..... 69/40

(58) Field of Classification Search
CPC ..... C14B 1/04; C14B 1/10; C14B 2700/16
USPC ..... 69/37, 39, 40, 42
See application file for complete search history.

(56) References Cited

U.S. PATENT DOCUMENTS

| | | | | |
|---|---|---|---|---|
| 2,272,348 | A * | 2/1942 | Newman | 69/37 |
| 2,639,603 | A | 5/1953 | Whitney | |
| 4,280,345 | A * | 7/1981 | Gimelfarb et al. | 69/32 |
| 4,314,465 | A | 2/1982 | Reid | |
| 4,745,782 | A | 5/1988 | Larsen | |
| 4,787,221 | A * | 11/1988 | Johansson | 69/40 |
| 2007/0277565 | A1 * | 12/2007 | Vind | 69/42 |

(Continued)

FOREIGN PATENT DOCUMENTS

| | | |
|---|---|---|
| DE | 2756758 | 7/1978 |
| DK | 156669 B3 | 9/1989 |

(Continued)

OTHER PUBLICATIONS

International Search Report for corresponding PCT/DK2011/000089 filed Aug. 4, 2011; Mail date Jan. 4, 2012.

*Primary Examiner* — Shaun R Hurley
(74) *Attorney, Agent, or Firm* — Cantor Colburn LLP

(57) ABSTRACT

An apparatus includes a tapering mandrel on which a tubular fur can be drawn. The apparatus further includes at least two scraper units having one or more scraper rollers which, during operation and in contact with the skin side of the fur, is arranged to rotate so that scraping elements on the scraper rollers scrape the skin side of the fur on opposite sides of the mandrel. The scraper units include a pressure arrangement to apply to the at least one scraper roller a contact pressure against the skin side, and a damper arrangement for damping the scraper unit movement away from the mandrel. Scraper units may be included on opposing mandrel sides, wherein each unit includes two rollers to act on the skin side with a friction force towards a second part of the mandrel; at least one of the rollers includes one or more V-shaped scraper elements.

25 Claims, 7 Drawing Sheets

(56) References Cited

U.S. PATENT DOCUMENTS

Figure 1:
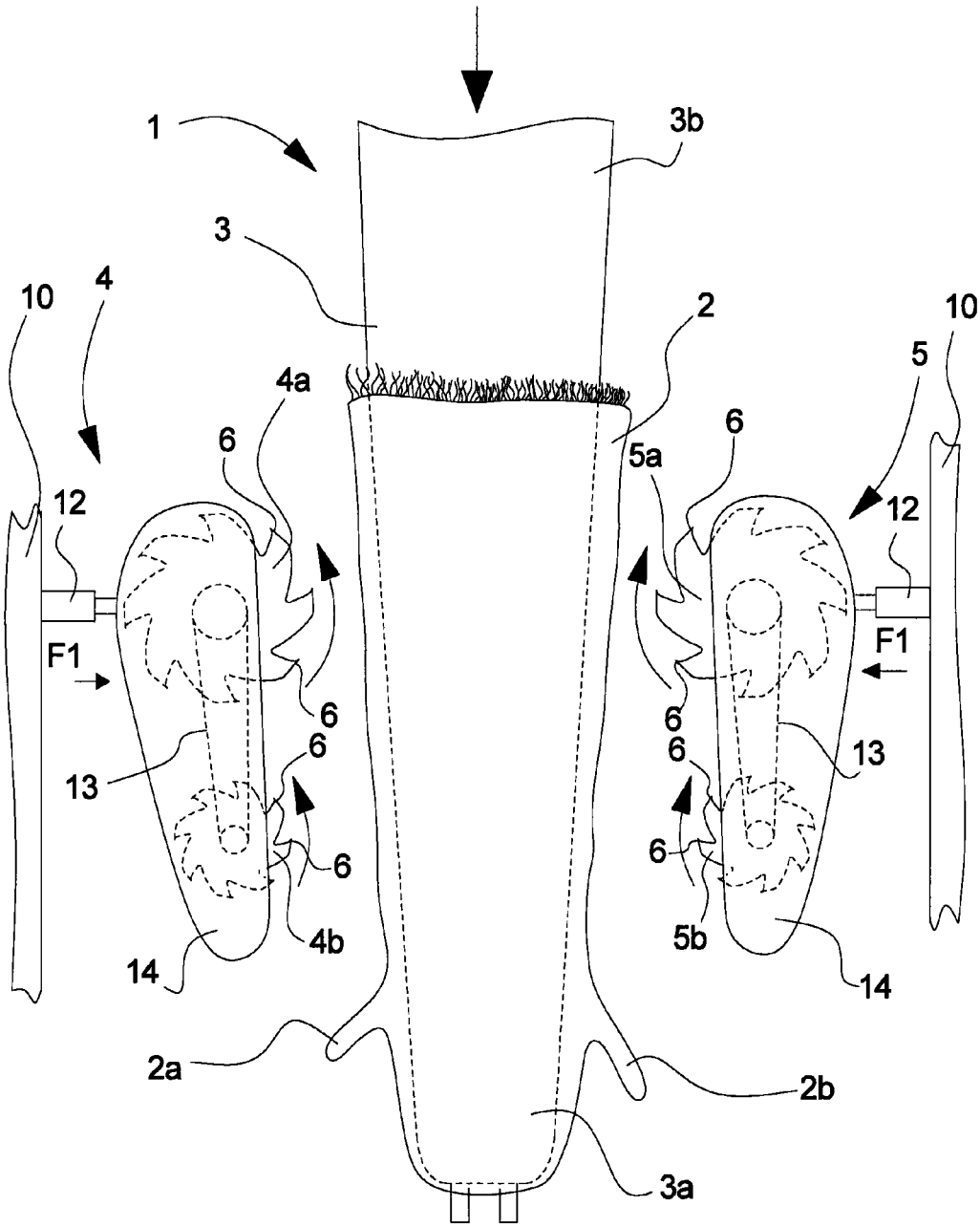

| | | | | |
|---|---|---|---|---|
| 2013/0139559 | A1* | 6/2013 | Pedersen | 69/40 |
| 2013/0139560 | A1* | 6/2013 | Pedersen | 69/44 |

FOREIGN PATENT DOCUMENTS

| | | | |
|---|---|---|---|
| DK | 169499 | B1 | 11/1994 |
| DK | 173202 | A | 3/2000 |
| DK | 173611 | A | 4/2001 |
| DK | 176528 | B1 | 7/2008 |
| EP | 2093299 | A1 | 8/2009 |
| FI | 105107 | | 6/2000 |
| GB | 742335 | | 12/1955 |
| WO | 2005068665 | A1 | 7/2005 |
| WO | 2011116771 | A1 | 9/2011 |

* cited by examiner

APPARATUS FOR PROCESSING FUR

This application is the U.S. national phase of International Patent Application Number PCT/DK2011/00089 filed on 4 Aug. 2011 which claims priority to Denmark Patent Application Numbers PA201000716 filed on 13 Aug. 2010 and BA201100055 filed on 21 Mar. 2011. The present application claims the benefit of said applications under 35 U.S.C. 373 and 119. All of said applications are herein incorporated by reference in their entirety.

The present invention relates to an apparatus for processing the skin side of a tubular fur by scraping the skin side by means of rotating scraping elements.

BACKGROUND

A skin taken from a furred animal such as a fur normally has a layer or residues of fat, tendons and/or flesh that is firmly attached to the skin side of the fur. Before the fur can be used for further processing, such layers or residues must be removed from the skin side.

A prior art apparatus for processing such furs to remove layers or residues of fat, tendons and/or flesh on the skin side is described in Danish patent specification DK156669. This apparatus comprises a single scraper roller with V-shaped scraping elements to scrape the skin on each side of a mandrel, on which a tubular fur is arranged with the skin side facing outwards.

Danish patent specification DK173611 describes an apparatus for processing fur on a mandrel. The apparatus comprises several scraper rollers that, while scraping the skin side of the fur, cause the fur to rotate about its longitudinal axis.

European patent specification EP2093299 concerns an apparatus for processing fur in which the apparatus comprises two scraper rollers driven in opposite directions of rotation to achieve both a friction force against a thick end of a mandrel on which a fur is arranged and a friction force against the thin end of the mandrel.

The above apparatuses have various disadvantages that the present invention resolves.

THE INVENTION

In a configuration of the invention, the apparatus comprises:

an apparatus for processing the skin side of a tubular fur, which apparatus comprises:

a tapering mandrel with a first part that is thinner than a second part of the mandrel, on which mandrel the tubular fur can be drawn from the first part of the mandrel towards the second part of the mandrel so that the skin side of the fur faces outwards and the fur side of the fur faces inwards towards the mandrel, at least a first scraper unit and a second scraper unit, each scraper unit comprising at least a first scraper roller which, during operation and in contact with the skin side, is arranged to rotate so that scraping elements on the scraper roller scrape the skin side of the fur on opposite sides of the mandrel, where the mandrel and the scraper units are arranged to be moved in relation to each other in the longitudinal direction of the mandrel, where the scraper units are arranged to be movable towards and away from the mandrel and comprise a pressure arrangement arranged to apply to said at least one scraper roller a contact pressure against the skin side, and where the apparatus comprises a damper arrangement for damping the movement of the scraper units towards and/or away from the mandrel.

The apparatus is provided with one or more actuators or other pressure arrangements that can control and apply the scraper rollers' contact pressure to the fur on the mandrel. When one scraper roller on the apparatus reaches an area on the fur with a projection (for example an area covered by/comprising skin parts that have covered the furred animal's legs), there is a risk that the scraper roller will unintentionally reduce the contact pressure on the fur on a piece of the fur during and/or after contact with the projection. The reason for this may be that actuators or other force-inducing means, which may be part of the pressure arrangement that applies the contact pressure and are often driven via pneumatics or hydraulics, are forced backwards by the projection for a moment, for example in connection with increased compression of the liquid or air in the actuator. The consequences of this may be that the skin is not scraped adequately by the scraper roller and there may therefore be flesh, fat and/or tendon residues that are not removed from the skin in these areas around the skin parts. By implementing a damper arrangement on the apparatus in a suitable location, it is possible to reduce or completely avoid unintentional reduction of the contact pressure and thus achieve better processing of areas around the skin parts which has covered the legs of the animal. It is/may also be possible to prevent the scraper rollers from skipping an area that is after these parts of the skin.

Note also that a damper device in accordance with the invention may advantageously be implemented in an apparatus such as that specified in European patent specification EP2093299.

In a preferred embodiment of the apparatus in the above damper configuration, the damper arrangement comprises one or more linear shock absorbers.

A linear shock absorber preferably comprises a cylinder and a piston arranged inside the cylinder, whereby the shock absorption is achieved by the piston compressing a fluid such as a liquid or gas inside the cylinder, which thus absorbs energy from the shock. Alternatively, the damper arrangement could comprise other suitable shock-absorbing means such as a shock-absorbing, compressible material, for example a rubber material with a suitable hardness that can have a shock-absorbing effect. Linear shock absorbers have proved to be useful for damping the scraper unit's movement towards and/or away from the mandrel. It is naturally understood that any suitable shock absorbing means may be utilized in aspects of the invention.

In a preferred embodiment, the damper arrangement comprises one or more shock-absorbing means arranged to absorb shock impacts in the horizontal plane towards and/or away from the mandrel.

Skin parts that have covered the furred animal's legs are often arranged on the side parts of the mandrel, and these areas are processed by scraper rollers with a rotational axis that is essentially vertical and is arranged to scrape the fur arranged on the mandrel's side parts by applying an essentially horizontal contact pressure. If projections on the fur can apply a force that opposes the horizontal scraper pressure, it may be particularly advantageous to absorb shock impacts in the horizontal plane.

It is also preferred that the damper arrangement or arrangements damp movements towards and/or away from the mandrel on any additional scraper units for scraping the skin side which might be on the apparatus/mandrel, including for example scraper units arranged to scrape the skin side arranged on the upper and/or lower part of the mandrel. Thus, the apparatus may, in embodiments, comprise a suitable number of shock-absorbing means and/or damper devices/arrangements arranged to damp shock impacts on both scraper rollers arranged to scrape skin parts on a fur arranged on the side of the mandrel and/or on the upper and/or lower part of the mandrel.

It is understood that the skin may in embodiments be arranged so that areas comprising skin parts that have covered the legs of the animal are arranged at the upper and lower part of the mandrel, and that the apparatus in such embodiments may be configured in a way so that these areas of the skin are scraped properly as described in this document.

The scraper units may each comprise at least one further scraper roller where the first scraper rollers and the second scraper rollers of the scraper units are arranged behind each other in the longitudinal direction of the mandrel so as to improve the scraping of the skin side of the fur on the mandrel.

By using scraper units with at least two scraper rollers (note that a scraper unit may also comprise more than two scraper rollers) that rotate in the same direction of rotation, and in particular where at least one of the scraper rollers has V-shaped scraper elements, tests have shown that it is possible to achieve adequate processing of the fur in the more difficult areas, in particular under and behind skin parts of the fur that have covered the front legs of the animal. The first scraper roller in a set of scraper rollers thus processes the fur before the second roller in the same set processes the same area of the fur. In this way, the second scraper roller is able to remove fat residues, tendons, flesh residues, etc. that have not been removed by the first scraper roller. It is thus possible to regard the processing performed by the first scraper roller as rough scraping of the skin side, while the processing performed by the second scraper roller can be regarded as fine scraping or supplementary scraping.

It has shown to be advantageous that said scraper rollers of said scraper units are arranged to act on the skin side with a friction force in the direction towards the second part of the mandrel.

It is furthermore preferred that at least one of the scraper rollers of each scraper unit comprises one or more substantially V-shaped scraper elements.

The V shape of the scraper rollers' scraper elements has several advantages. Firstly, the scraper elements prevent the fur from rotating on the mandrel. Among other things, this results in increased control over the scraping of the fur. The V shape also means that the fur on the mandrel can be stretched towards or away from a plane that passes through the centre axis of the mandrel in the longitudinal direction of the mandrel so that areas around edges or curves on the mandrel are processed, depending on how the scraper rollers are turned. The scraper rollers with the V-shaped scraper elements are arranged preferably so that the points of contact between the scraper rollers and the fur for each of the scraper elements' scraping edges, during operation, stretch the fur towards a plane that passes through the centre axis of the mandrel in the longitudinal direction of the mandrel. Thus, e.g. the parts of the skin arranged on edges of the mandrel (for example in embodiments where the mandrel comprises substantially plane surfaces, e.g. a square formed tapering mandrel with four edges extending in the longitudinal direction of the mandrel) the skin parts at or near the edges are adequately scraped.

In an embodiment, one or more of the rollers in a scraper unit can be arranged so that the points of contact between the scraper rollers and the fur for each of the scraper elements' scraping edges move away from a plane that passes through the centre axis of the mandrel in the longitudinal direction of the mandrel. In this way, the fur is stretched away from the plane.

Note in general that the scraper rollers in a scraper unit, which comprises several scraper rollers, can be arranged in parallel (which is preferred in several cases), but they can also be arranged at an angle to each other.

A scraper unit with several scraper rollers may also comprise scraper rollers with another (other) characteristic(s) than V-shaped scraper elements, for example essentially parallel, inclined scraper elements, several scraper elements arranged in a V shape with spaces between the end parts of the scraper elements, and/or similar.

In a preferred embodiment of the invention, at least two scraper rollers in a scraper unit have different characteristics.

The term 'different characteristics' means that the scraper rollers in a set of scraper rollers may, for example, have a different design and/or size, a different number of scraper elements, a different angle of the scraper elements on the scraper rollers, a different design of the scraper elements on the rollers, a different arrangement of the scraper rollers, etc. This may have the advantage that it is possible to achieve different types of processing of the skin side of the fur in the same working process.

In one embodiment of the invention, the different characteristics comprise at least that one scraper unit comprises two scraper rollers with opposing, essentially V-shaped scraper elements.

In this way, one of the two scraper rollers can stretch the fur away from a plane that passes through the centre axis of the mandrel in the longitudinal direction of the mandrel, while the other of the two scraper rollers stretches the fur towards the same plane that passes through the centre axis of the mandrel in the longitudinal direction of the mandrel. This may have certain advantages as the opposing scraper elements cause force impacts on the fur in different directions in the same procedure.

In one embodiment of the invention, the different characteristics comprise at least that one scraper roller in a scraper unit, during operation, is arranged to rotate at a speed that is higher than another scraper roller in the same scraper unit.

Different roller speeds may cause different peripheral speeds of the scraper rollers in a scraper unit. As the fur can, in this way, be scraped with scraper rollers at different speeds, this may have a positive effect on the quality of the processing of the fur. A non-limiting example may be that the first scraper roller in a scraper unit is driven at a speed of between 1200 and 1600 RPM, and a second scraper roller in the scraper unit can be driven at a rotational speed of between 2000 RPM and 2500 RPM.

It is also possible, by rotating the rollers at different speeds, to achieve a situation in which different sizes of scraper rollers are able to cause essentially the same effect on the skin side, for example by adjusting the speed of the scraper rollers so that the peripheral speed is the same, by the speed being adapted so that the skin side experiences essentially the same number of scraping actions from the scraper elements on both scraper rollers when the fur passes the rollers. This makes it possible to achieve easier implementation of several scraper rollers in one apparatus with limited space available.

In one embodiment of the invention, the different characteristics comprise at least that one scraper roller in a scraper unit has a diameter that is larger than the diameter of another scraper roller in the same scraper unit.

This may have certain advantages as this makes it possible easily to achieve different peripheral speeds for the scraper rollers. It is also possible to achieve a space-saving solution.

In a preferred embodiment of the invention, the scraper rollers in a scraper unit, during operation, are arranged to rotate around an essentially vertical axis to scrape the skin side arranged on side parts of the mandrel.

Note, of course, that one or more scraper rollers in embodiments may be arranged to rotate around an essentially horizontal axis to scrape fur parts/sections arranged on the top and/or bottom of the mandrel.

The apparatus is preferably also provided with two additional scraper units each comprising at least one scraper roller arranged so that the two additional scraper units during operation of the apparatus will apply a force to the skin side from opposite sides of the mandrel in a direction towards the second part of the mandrel, where the additional scraper units are arranged to rotate around an essentially horizontal axis during operation of the apparatus in order thus to scrape at least one part of the fur that is not or will not be processed by the first scraper unit or second scraper unit.

By scraping the entire skin side of the fur in the same procedure, it is possible to achieve increased fur processing speed, in which connection several furs can be scraped. Examples of a machine with both scraper rollers that rotate around a vertical axis to scrape fur on side parts of the mandrel and scraper rollers that rotate around a horizontal axis to scrape fur on the top and bottom of the mandrel have made it possible to process more than 200 mink furs in an hour.

Note, however, that there may be an overlap between the processing by the first or second scraper roller unit and the additional scraper units. For example on account of extensions/stretching of the fur caused by the preferred V shape of the scraper rollers.

The scraper rollers of a scraper unit are in a preferred embodiment of the present invention arranged to be driven by the same drive means such as an electric motor.

It is advantageous to drive several scraper rollers using the same drive unit as this represents a cost efficient solution in relation to driving each roller with an individual drive unit. Note, of course, that each scraper roller in embodiments may also be driven individually by a separate drive unit, and any suitable arrangement of scraper rollers and drive units in different embodiments of the invention may be used.

In a preferred embodiment of the invention, the scraper rollers in a scraper unit are arranged to be driven by means of the same belt drive or chain drive.

As the scraper rollers in a scraper unit rotate in the same direction towards the thicker end of the mandrel, it is possible to drive the scraper rollers via a belt drive or a chain drive, which is a cost efficient, reliable way in which to drive rotating parts. For example to drive several scraper rollers with the same drive unit. Alternatively, the scraper rollers in a scraper unit could be driven by means of, for example, an arrangement of gearwheels.

It is furthermore preferred that the mandrel is arranged to be driven at different predefined speeds, comprising at least a first predefined speed and a second predefined speed, where the first predefined speed is lower than the second predefined speed, and where the apparatus is arranged to switch between the first predefined speed and the second predefined speed when the fur on the mandrel is in different predefined positions.

Experience shows that in particular the area around the front legs of a fur, such as a mink fur, can often be difficult to process to remove, for example, flesh residues, fat, tendons and other material from the skin side of the fur. This is because areas, in particular under and behind skin parts of the fur that have covered the front legs of the animal may, when the fur is being scraped, cover an area on the skin side that is thus not processed adequately. By using and switching between several predefined speeds, it is possible to obtain a satisfactory processing of the fur in the mentioned areas by advancing the mandrel and the fur on it with a lower speed and provide an overall increase the speed of the processing of the fur without compromising on the quality of the fur when it is scraped.

In an embodiment of the apparatus in the above configuration, the switch is arranged to take place on the basis of the location of the fur in relation to a scraper roller.

By determining the location of the fur, it is possible to scrape different areas of the fur, where the mandrel is driven at different speeds. This makes it possible to achieve more advantageous, individual scraping of the fur. For example, areas on the fur that comprise skin parts that have covered the furred animal's legs may be processed while the mandrel is driven at the first speed, while the rest of the fur may be processed while the mandrel is driven at the second speed.

In general it is to be understood that the location of the fur in relation to a scraper roller may be determined by detecting the fur via a sensor, by detecting the location of the mandrel in relation to scraper rollers or another point on the apparatus or similar. An example might be to count the number of chain links during operation, if the mandrel is driven by a chain drive, to determine the location of the fur.

In an embodiment of the apparatus in the above configuration, the mandrel is arranged to be driven at the first speed in and/or around areas on the fur that are, or may be, covered by skin parts that have covered the furred animal's legs.

These areas have been shown to possibly require special processing to achieve adequate scraping of the fur in these areas.

In an embodiment of the apparatus in the above configuration, the mandrel is arranged to be driven at the second predefined speed after areas on the fur that are, or may be, covered by skin parts that have covered the furred animal's legs have been processed by the scraper roller.

This allows faster processing of the fur to be achieved.

In an embodiment of the apparatus in the above configuration, the mandrel is arranged to be driven at the second speed until or just before the scraper roller comes into contact with the fur on the mandrel.

Faster processing of the fur is thus achieved as the fur, after it has been arranged on the mandrel, needs to come into contact with the scraper rollers to be processed.

It is furthermore preferred that the mandrel is arranged to be driven with the second predefined speed towards areas on the fur which are or may be covered by skin parts that have covered the furred animal's legs. Hereby, the lower, first predefined speed of the mandrel is applied only is the areas where the more thorough scraping obtained by the lower mandrel speed is most required, i.e. the areas which are or may be covered by skin parts that have covered the furred animal's legs which provides for a fast processing of the individual fur.

In yet a preferred embodiment of the present invention, the mandrel is arranged to be driven with the said first predefined speed until areas on the fur which are or may be covered by skin parts that have covered the furred animal's legs has been processed by said at least one scraper roller whereupon the mandrel is driven with said second predefined speed.

The first predefined speed is preferably no higher than 0.35 m/s, for example no higher than 0.32 m/s, such as no higher than 0.30 m/s.

Examples of the second, higher predefined speed might be >0.35 m/s, for example >0.37 m/s, such as >0.40 m/s.

It has been shown that this speed is particularly advantageous for processing mink fur in particular, as fast, thorough scraping of the fur is achieved.

In a further configuration of the invention, the apparatus comprises:

a tapering mandrel with a first part that is thinner than a second part of the mandrel, on which mandrel the tubular fur can be drawn from the first part of the mandrel towards the second part of the mandrel so that the skin side of the fur faces outwards and the fur side of the fur faces inwards towards the mandrel, at least a first scraper unit and a second scraper unit arranged on opposite sides of the mandrel with scraping means in the form of at least a first scraper roller and a second scraper roller that are arranged behind each other in the longitudinal direction of the mandrel and are designed, during operation and in contact with the skin side, to rotate so that scraper elements on the scraper rollers scrape the skin side of the fur, where the mandrel and the scraper units are arranged to be moved in relation to each other in the longitudinal direction of the mandrel, where the scraper rollers, during operation and in contact with the skin side, are arranged to act on the skin side with a friction force in the direction towards the second part of the mandrel, where at least one of the scraper rollers in each scraper unit comprises one or more essentially V-shaped scraper elements.

Experience shows that in particular the area around the front legs of a fur, such as a mink fur, can often be difficult to process to remove, for example, flesh residues, fat, tendons and other material from the skin side of the fur. This is because areas, in particular under and behind skin parts of the fur that have covered the front legs of the animal may, when the fur is being scraped, cover an area on the skin side that is thus not processed adequately. By using scraper units with at least two scraper rollers (note that a scraper unit may also comprise more than two scraper rollers) that rotate in the same direction of rotation, where at least one of the scraper rollers has V-shaped scraper elements, tests have shown that it is possible to achieve adequate processing of the fur in these areas. The first scraper roller in a set of scraper rollers thus processes the fur before the second roller in the same set processes the same area of the fur. In this way, the second scraper roller is able to remove fat residues, tendons, flesh residues, etc. that have not been removed by the first scraper roller. It is thus possible to regard the processing performed by the first scraper roller as rough scraping of the skin side, while the processing performed by the second scraper roller can be regarded as fine scraping or supplementary scraping.

Further advantages and particular embodiments and arrangements of the scraper rollers have been discussed previously with reference to the first-mentioned configuration of the apparatus and these may also be applied to this further configuration of the apparatus.

The invention furthermore concerns a computer program product designed for installation to control an apparatus in accordance with one or more embodiments described in his document where the mandrel is driven with different speeds, where the computer program product is adapted to drive the mandrel at the different predefined speeds when the computer program product is installed to control the apparatus.

Such a computer program product may, for example, be advantageous in connection with improvements to existing apparatuses as the program may, for example, be installed as a software update to make it possible to use different mandrel drive speeds as described in the document. Note, of course, that the computer program product in the embodiments may be installed in new machines.

FIGURES

Figure 2:
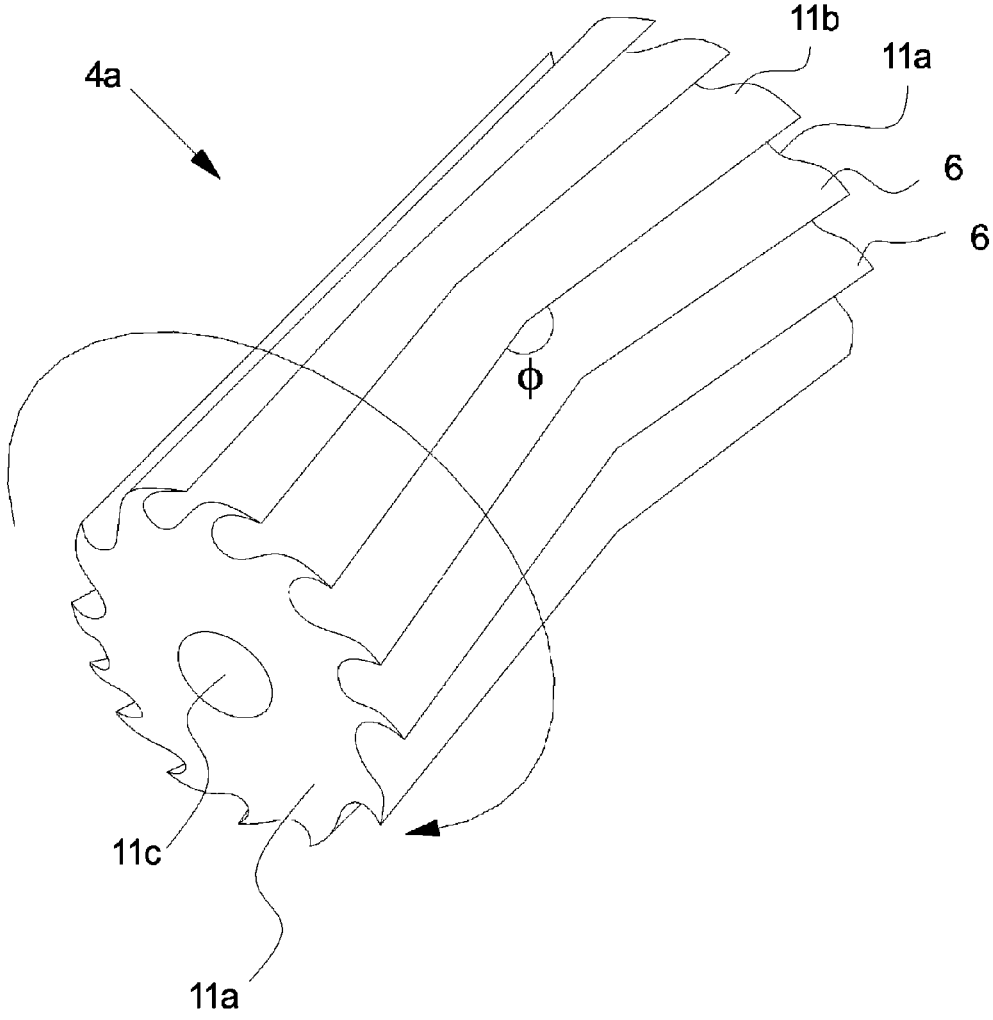
Figure 3:
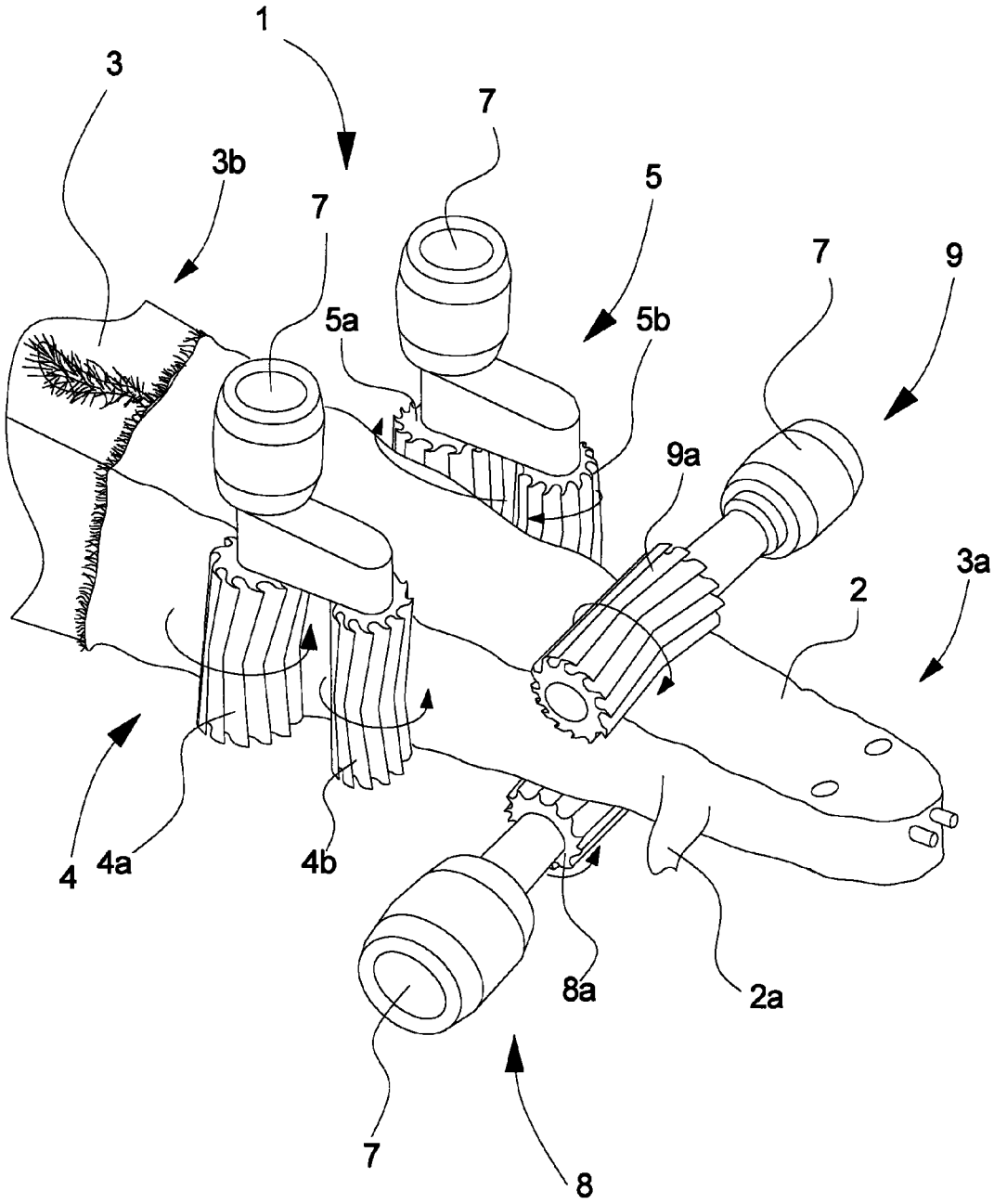
Figure 4:
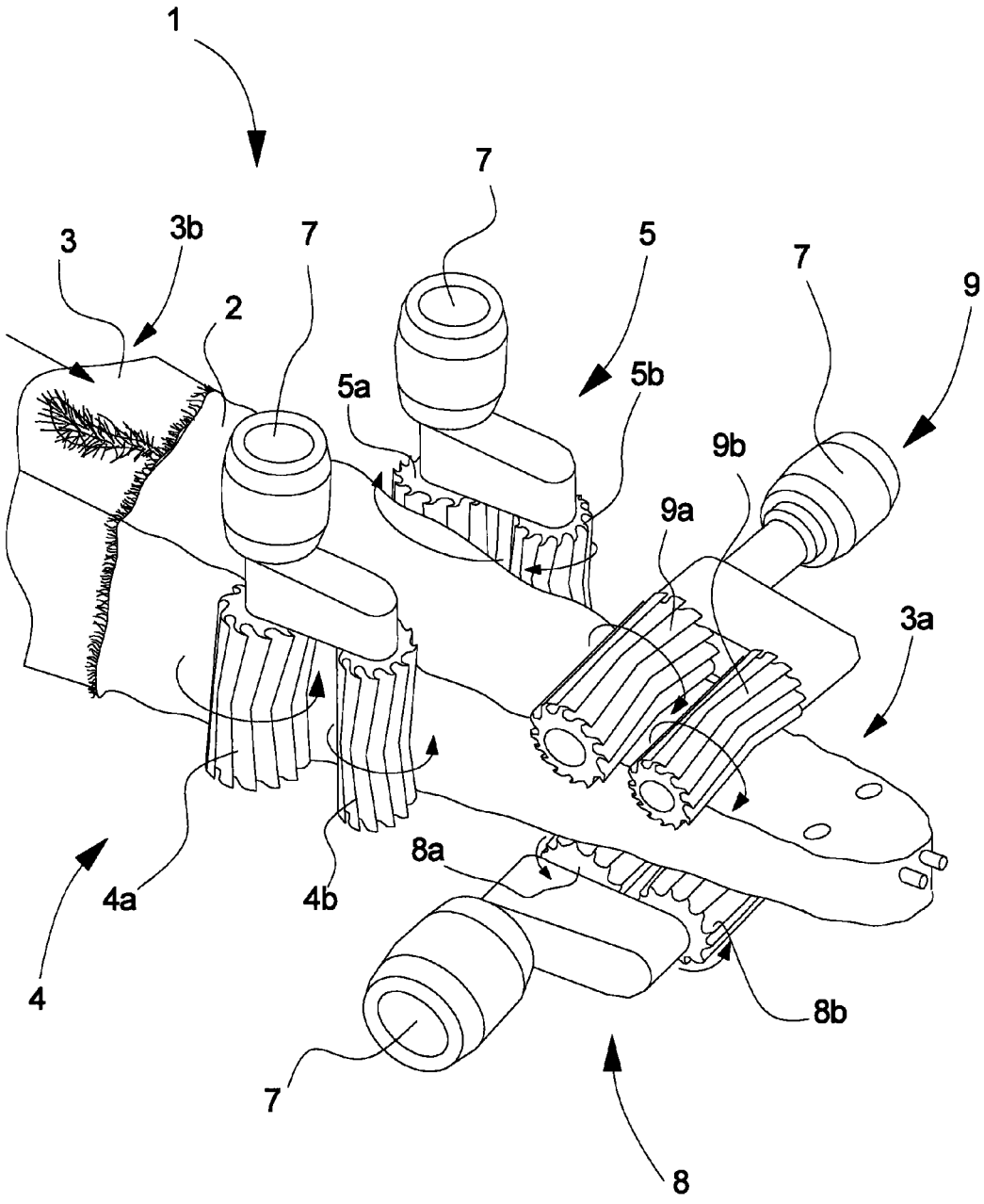
Figure 5:
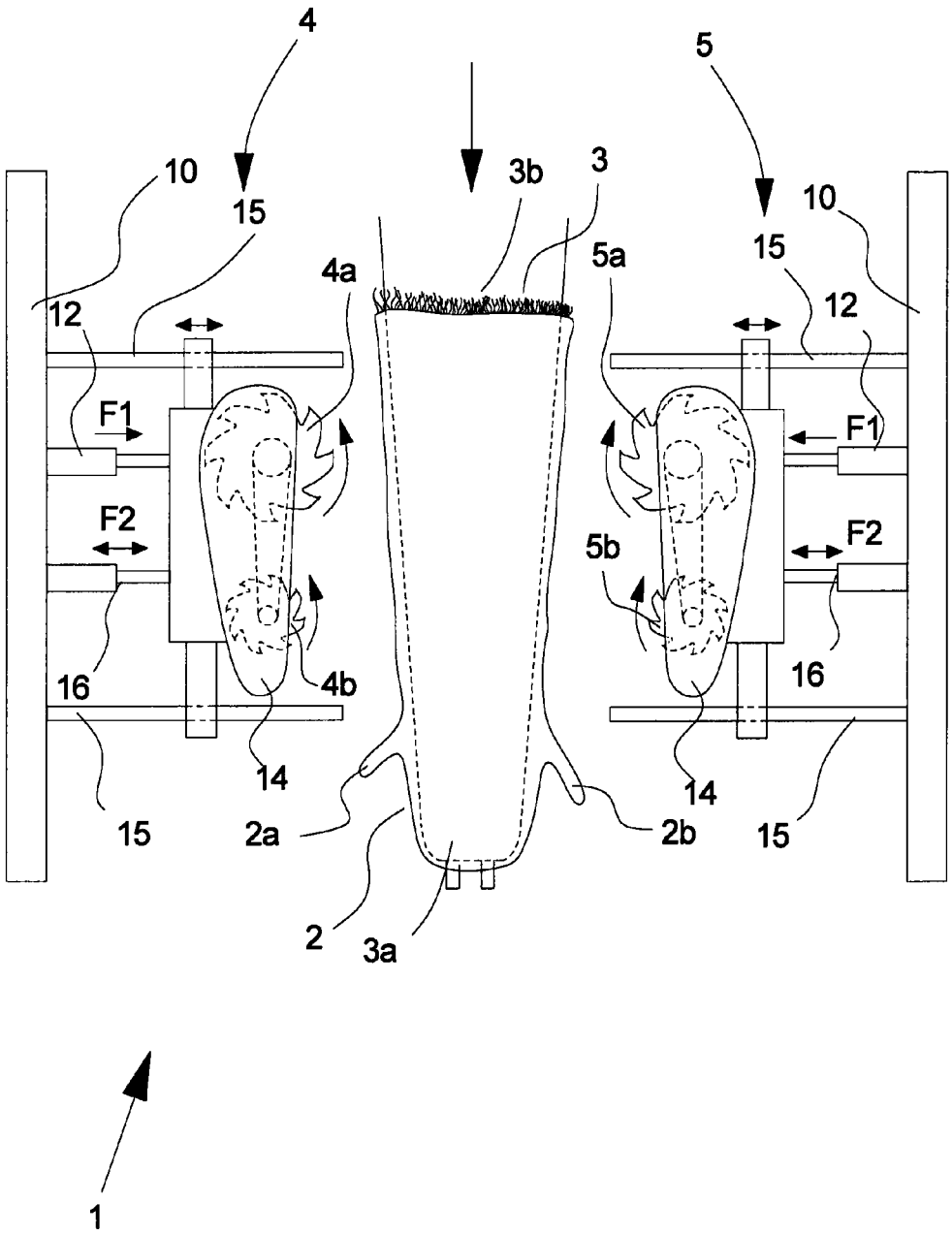
Figure 6:
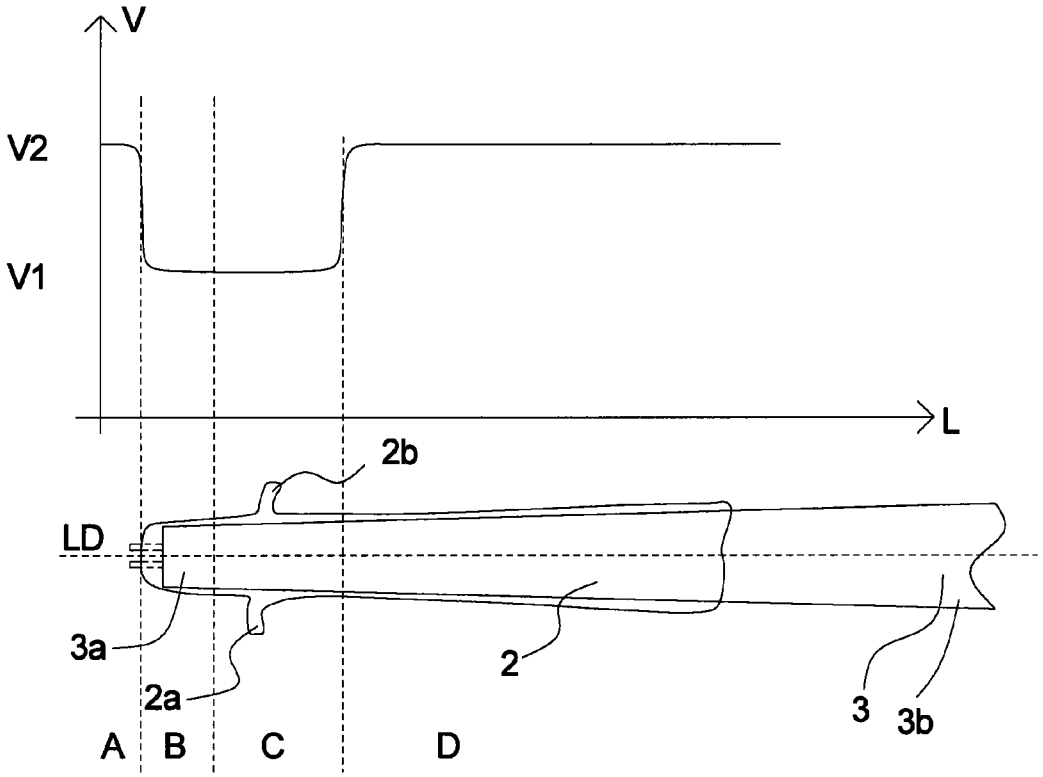
Figure 7:
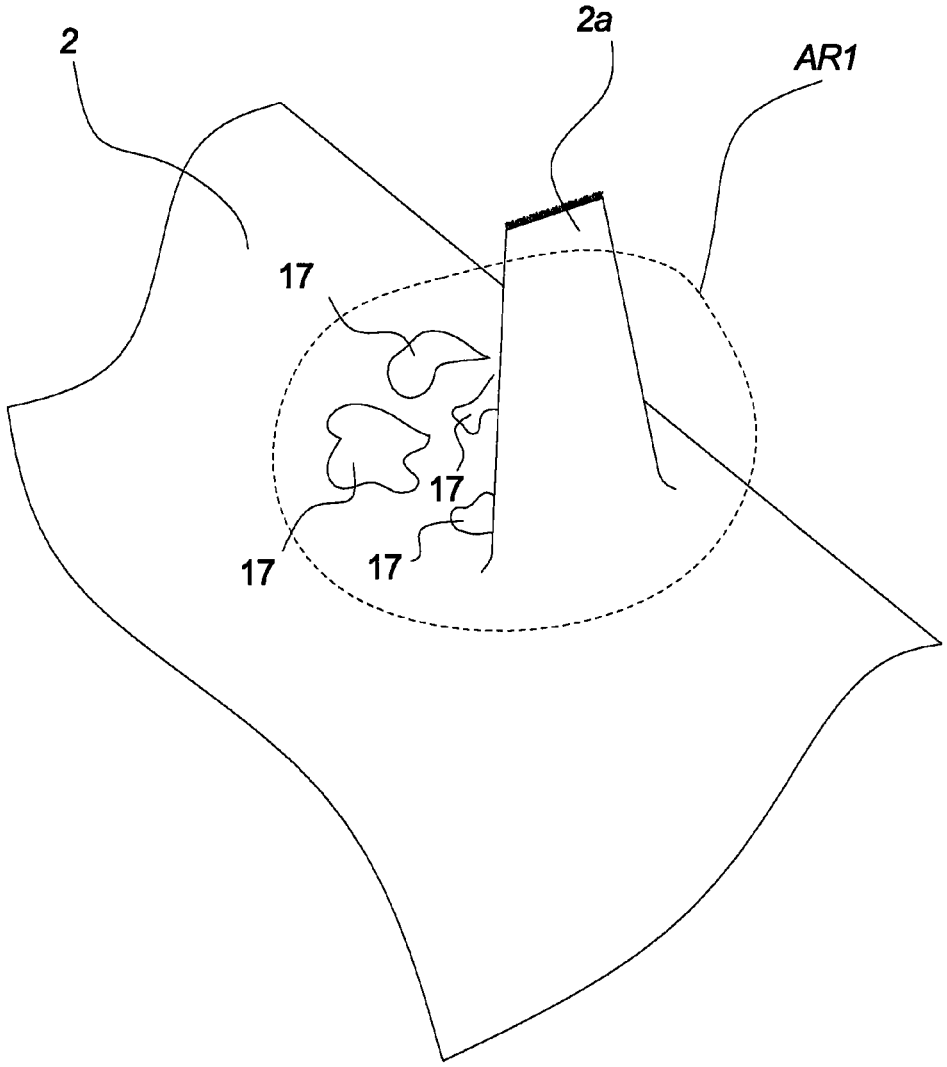

The following contains non-limiting examples of embodiments of the invention described and explained in detail with reference to the figures, where:

FIG. 1: shows a diagram of a preferred embodiment of part of an apparatus in accordance with the invention, with scraper units with several scraper rollers seen from above, FIG. 2: shows a preferred embodiment of a scraper roller used in the apparatus, seen in perspective, FIG. 3: shows a preferred embodiment of part of an apparatus in accordance with the invention, seen in perspective, with both horizontal and vertical scraper rollers, FIG. 4: shows a preferred embodiment of part of an apparatus in accordance with the invention, seen in perspective, where the apparatus comprises various scraper units with several scraper rollers, FIG. 5: shows an embodiment of the invention where the apparatus comprises a damper device, FIG. 6: shows an embodiment of the invention where the apparatus can drive a mandrel at one or more predefined speeds, and where FIG. 7: shows an example of an area on a fur that the apparatus in accordance with the invention is particularly designed also to scrape adequately.

DETAILED DESCRIPTION

FIG. 1 shows an advantageous embodiment of an apparatus 1 in accordance with the invention for processing the skin side of a tubular fur 2, preferably a mink fur.

The tubular fur 2 comprises a fur side and a skin side. The fur comprises different skin parts that originally, before the fur was removed from the furred animal, enclosed different parts of the body of the furred animal. For example skin parts 2*a*, 2*b* that enclosed the legs of the furred animal.

The fur is placed on a mandrel 3 with a first part 3*a* that is thinner than a second part 3*b* of the mandrel 3. The mandrel thus creates/forms a mandrel 3 with a tapered end, where the fur 2 can be drawn on the mandrel from the thin part 3*a* of the mandrel 3.

The apparatus also comprises one, two or more scraper units 4, 5, preferably at least two scraper units 4, 5. Each scraper unit 4, 5 comprises, as shown, at least two scraping means in the form of scraper rollers 4*a*, 4*b*, 5*a*, 5*b* designed to rotate to apply a force F1 to the skin side of the fur from opposite sides of the mandrel 3 in a direction towards the second part 3*b* of the mandrel, i.e. the thicker part of the mandrel. The first scraper unit 4 thus comprises a first scraper roller 4*a* and a second scraper roller 4*b*, and the second scraper unit 5 comprises a first scraper roller 5*a* and a second scraper roller 5*b*.

The scraper rollers in a scraper unit 4, 5 are, as indicated with arrows, arranged to rotate in the same direction of rotation. This means that the scraper rollers 4*a*, 4*b* in the first scraper unit 4 are arranged to rotate in the same direction of rotation and the scraper rollers 5*a*, 5*b* in the second scraper unit 5 are arranged to rotate in the same direction of rotation.

As shown, the scraper rollers 4*a*, 4*b* rotate in the same direction of rotation during operation but in a direction of rotation that is the opposite direction of rotation to that of the scraper rollers 5*a*, 5*b*. As can be seen, the scraper rollers 4*a*, 4*b*, 5*a*, 5*b* rotate around centre axes (not shown) of the scraper rollers that are essentially parallel. In other embodiments, the scraper rollers in a scraper unit 4, 5 could be arranged at an angle to each other (not shown).

The mandrel 3 and the scraper units 4, 5 are arranged to be moved in relation to each other in the longitudinal direction LD of the mandrel. This is preferably achieved by the mandrel 3 being moved towards the tapered end of the mandrel 3, while the scraper units 4, 5 are not moved in the longitudinal direction of the mandrel. Alternatively, the mandrel could be fixed and the scraper units could thus be moved along the mandrel 3. Equally, both the mandrel 3 and the scraper units 4*a*, 4*b* could be moved in relation to each other.

In embodiments in which the mandrel 3 is moved in a direction towards the tapered end of the mandrel 3, the scraper rollers 4*a*, 4*b*, 5*a*, 5*b* will apply a force against the direction of motion of the mandrel, against the thicker, second part of the mandrel 3*b*.

The scraper units 4, 5 are arranged to be movable towards and away from the mandrel 3 in order to be able to apply a controlled contract pressure against the skin side of the fur on the mandrel. This may, for example, be controlled via one or more pressure arrangements 12, comprising, for example, linear actuators such as pneumatic cylinders, a spindle or other device, preferably as described in further details below.

Each of the scraper rollers and/or each scraper unit may be mounted to oscillate around an axis of oscillation (not shown) in relation to the frame 10 of the apparatus 1.

As indicated in FIG. 1, scraper rollers are driven in a scraper unit, preferably via the same belt drive or chain drive 13, as the scraper rollers in a scraper unit 4, 5 are driven in the same direction of rotation, as shown with arrows. Alternatively, it would be possible to use a gearwheel arrangement.

FIG. 2 shows an example of a preferred scraper roller, called 4*a* in FIG. 2, but it could be any scraper roller in a scraper arrangement in apparatus 1. The scraper roller 4*a* comprises end surfaces 11*a* between which there is a continuous peripheral surface 11*b*. The peripheral surface 11*b* has a number of scraper elements 6 mounted at peripheral distances from each other that determine or are located on a generally circular, cylindrical surface. Each scraper element 6 is generally V-shaped. The scraper element preferably forms an obtuse angle Φ, but it can also form an acute angle. The V-shaped scraper elements' top points are located in a plane of symmetry that is substantially perpendicular to the roller's axis. Seen in cross-section, the roller has an outline that is reminiscent of a circular saw blade. The scraper roller also has an axial drilled hole 11*c* for receiving a drive shaft.

The scraper roller 4*a*, which is preferably made of rubber, plastic material or a similar elastic, ductile material, is preferably caused to rotate in the direction of rotation indicated with an arrow in FIG. 2. This means that the fur that is processed will first be brought into contact with free outer ends of each of the scraper elements 6 and, during the continued rotation of the scraper roller, the two points of contact of each of the scraping edges will move in a direction towards the scraper roller's central plane of symmetry where the tip of the V shape is formed. As a consequence of this, the roller will have a tendency to pull the fur on the mandrel in a direction towards this central plane. This situation will, in this connection, cause the residues of fat, flesh and/or tendons also to be removed from the parts of the fur located along the edges of the mandrel 3.

Likewise, a scraper roller could also be imagined with scraper elements 6 with a V shape that causes the roller, during its continued rotation, to move the two points of contact of each of the scraper elements 6 in a direction away from the roller's central plane of symmetry towards free outer ends of each of the scraper elements 6. As a consequence of this, the scraper roller will have a tendency to pull the fur in a direction away from the roller's plane of symmetry.

Note in general that the scraper rollers in a scraper unit 4, 5, as indicated, for example, in FIG. 1, may have different diameters. In non-limiting examples, it could be imagined that the diameter of the first scraper roller 4*a*, 5*a* has a diameter that is over twice the diameter of the second scraper roller 4*b*, 5*b*. For example, the first scraper roller 4*a*, 5*a* could have a diameter of between 100 and 150 mm, while the second scraper roller could have a diameter of between 40 and 70 mm. In a specific test with a test setup of the apparatus 1, tests were carried out with scraper units 4, 5, comprising a first scraper roller 4*a*, 5*a* with a diameter of approximately 132 mm and a second scraper roller 4*b*, 5*b* with a diameter of approximately 65 mm, with satisfactory results.

FIG. 3 shows an embodiment of the apparatus 1, comprising both scraper rollers 8*a*, 9*a* arranged horizontally and scraper rollers 4*a*, 4*b*, 5*a*, 5*b* arranged vertically. Each scraper unit 4, 5, 8, 9 comprises, in this embodiment, at least one drive unit 7, to drive the scraper rollers 4*a*, 4*b*, 5*a*, 5*b*, 8*a*, 9*a*. The scraper units 8, 9 with the horizontally arranged scraper rollers 8*a*, 9*a* are arranged to apply a force to the skin side from opposite sides of the mandrel 3, i.e. in this case the top and bottom surfaces of the mandrel, in a direction towards the second part 3*b* of the mandrel. The scraper units 4, 5 with the vertically arranged scraper rollers 4*a*, 4*b*, 5*a*, 5*b* are also arranged to apply a force to the skin side from opposite sides of the mandrel 3, in this case the side parts of the mandrel 3, in a direction towards the second part 3*b* of the mandrel 3.

The scraper units 8, 9 with the horizontal scraper rollers are preferably displaced in relation to the scraper units 4, 5 with the vertical scraper rollers, along the longitudinal direction LD of the mandrel. This, together with the V shape of the scraper elements, causes the residues of fat, flesh and/or tendons also to be removed from the parts of the fur 2 located along the edges of the mandrel 3.

As indicated in FIG. 3, the scraper rollers 4*a*, 4*b*, 5*a*, 5*b* in a scraper unit 4, 5 with several scraper rollers may be driven by the same drive unit 7, which is preferably an electric motor. Alternatively, each scraper roller in a scraper unit 4, 5, 8, 9 could be driven by an individual drive unit 7.

In the examples indicated in, for example, FIGS. 1 and 3, the scraper rollers 4*a*, 4*b*, 5*a*, 5*b* in a scraper arrangement are driven by the same drive unit 7 via a belt drive or a chain drive. The belt drive, chain drive or gearwheel arrangement is preferably arranged inside a casing 14 for reasons of hygiene and safety.

FIG. 4 shows an embodiment of the invention in which both the scraper units 4, 5 arranged on opposite sides of the mandrel to scrape the skin side on the side parts of the mandrel 3 and the scraper units 8, 9 arranged on opposite sides of the mandrel to scrape the skin side on the upper and lower parts of the mandrel 3 all comprise two scraper rollers 4*a*, 4*b*, 5*a*, 5*b*, 8*a*, 8*b*, 9*a*, 9*b*. All scraper rollers are arranged to rotate to act on the skin side with a friction force in a direction towards the second part 3*b* of the mandrel 3.

FIG. 5 shows an additional advantageous embodiment of the apparatus in accordance with the present invention, seen from above. As indicated in FIG. 5, the apparatus comprises a guide arrangement arranged to guide each scraper unit 4, 5 during its movement to apply a contact pressure on the skin side on the mandrel 3. The guide arrangement comprises, in this embodiment, two guide elements 15 in the form of parallel, fixed rods that are arranged essentially perpendicular to the longitudinal direction of the mandrel 3. A scraper unit is thus connected to these parallel rods and may be guided and displaced in relation to the rods 15 in the longitudinal direction of the rods. Alternatively, the guide elements could comprise other elements in the form of, for example, a hinge (not shown) connected to both the frame of the apparatus 1 and a scraper unit, around which the scraper unit can rotate. Other suitable ways of guiding the scraper units could also be relevant for use in the present invention.

The contact pressure F1 of a scraper unit is controlled and regulated preferably via one or more pressure arrangements 12, preferably in the form of one or more linear actuators. This/these pressure arrangements 12 may, on activation, cause the scraper roller/scraper rollers 4*a*, 4*b*, 5*a*, 5*b* in a scraper unit to be pressed against the fur on the mandrel 3. FIG. 5 shows two scraper units 4, 5 that can be pressed against the mandrel, each via its pressure arrangement.

As indicated, one scraper unit 4, 5 in, for example, this embodiment may thus comprise only one scraper roller 4*a*, 5*a* (not shown in any figures), two scraper rollers 4*a*, 4*b*, 5*a*, 5*b* as shown in one or more of the FIGS. 1, 3, 4 and 5 and specified in the associated description or even more scraper rollers.

The pressure may preferably be adjusted on the basis of the characteristics of the fur. For example, it has been shown to be advantageous to vary the contact pressure on the basis of the gender of the animal from which a mink fur, in particular, has been taken. The contact pressure could also be varied actively during the processing of a fur.

As shown in FIG. 5, the apparatus also comprises one or more damper arrangements 16 to damp a scraper unit's 4, 5 movement towards and/or away from the mandrel 3, for example caused by projections on the fur on the mandrel (such as projections comprising skin parts that have covered the furred animal's legs), caused by the mandrel 3 unintentionally making a sideways movement perpendicular to its longitudinal direction LD or similar. The damper device(s) can thus absorb forces F2 towards and/or away from the mandrel 3.

The damper arrangement(s) 16 comprise(s) preferably one or more linear shock absorbers as shown, comprising a cylinder and a piston that can be displaced inside the cylinder in the longitudinal direction of the cylinder. The damper arrangement(s) 16 preferably absorb(s) shock impacts in the horizontal plane towards and/or away from the mandrel 3.

The damper arrangement(s) is/are preferably designed and arranged in such a way that it/they reduce(s) the compression of the pressure arrangements(s) 12 and reduce the oscillations of the scraper unit(s).

The damper arrangement may thus comprise one or more shock-absorbing means arranged to damp horizontal and/or vertical oscillations/shocks. The damper device may also comprise one or more shock-absorbing means that damp shock impacts in other directions perpendicular to (and/or with components perpendicular to) the longitudinal direction of the mandrel 3.

It is thus noted that, for example, an apparatus comprising scraper units 8, 9, preferably arranged on opposite sides of the mandrel to scrape the skin side of the upper and lower parts of the mandrel, for example as shown in FIGS. 3 and 4 in embodiments, may also comprise shock-absorbing means to counteract the movement of the scraper roller(s) 8*a*, 8*b*, 9*a*, 9*b* and/or scraper units 8, 9 towards and away from the mandrel when they are arranged to be in contact with the mandrel.

The apparatus may, therefore, in different embodiments, comprise damper devices 16 designed to absorb shock impacts towards and away from the mandrel 3 on scraper units 4, 5, 8, 9 and/or their scraper rollers 4*a*, 4*b*, 5*a*, 5*b*, 8*a*, 8*b*, 9*a*, 9*b*.

The damper arrangement 16 may comprise passive, shock-absorbing elements and the damper device may comprise active shock-absorbing means controlled by a control unit (not shown) in the apparatus 1. Such active shock-absorbing means could, in one embodiment, be implemented via PD (Proportional-Derivative) regulation, PID (Proportional-Integral-Derivative) regulation or similar.

In an additional advantageous embodiment, the mandrel 3, may be moved in the longitudinal direction LD of the mandrel in a direction towards the first part 3*a* of the mandrel at a first predefined speed V1 that is no higher than 0.35 [m/s], for example no higher than 0.32 [m/s], such as no higher than 0.30 [m/s].

As shown in FIG. 6, the apparatus may also be designed to drive the mandrel at a second predefined speed V2, where the first predefined speed V1 is lower than the second predefined speed V2. The apparatus is thus designed to switch (preferably automatically) between the first predefined speed V1 and the second predefined speed V2 when the fur 2 on the mandrel 3 is in different predefined positions/areas. In the embodiment of the invention shown in FIG. 6, the apparatus 1 is arranged to drive the mandrel 3 at the first speed V1 essentially from the front end of the fur 2 until the scraper roller(s) in a scraper unit has(have) processed and passed areas C with and around skin parts of fur 2 that have enclosed the furred animal's legs. The speed then switches automatically to the second, higher speed V2 as indicated in area D.

In an additional embodiment, the mandrel 3 may be driven at the second speed V2 (or a third speed) until or just before a scraper roller in a scraper unit comes into contact with the fur on the mandrel (area A).

The mandrel 3 may also, in one embodiment, be driven at the first speed V1 or a second predefined speed until the scraper rollers have proper contact with the fur in area B before area C with and around skin parts 2*a*, 2*b*. This may be relevant as it has been shown that, in some cases, the speed of the mandrel may affect how well the scraper elements can get under tendons and fat, in particular, at the front end of the fur 2 when the scraper elements come into contact with the fur.

Note in general that the apparatus 1 preferably comprises a control unit (not shown in any figure) to control the contact pressure of the scraper rollers on the mandrel, propulsion of the mandrel, rotation of scraper rollers and possibly further processing of the fur, etc. This further processing may, for example, comprise the apparatus 1 applying sawdust to the skin side of the fur after it has been scraped, the fur automatically being turned off the mandrel after the scraping and/or similar.

Thus, it is to be understood that the control unit may, for example, comprise a control system comprising suitable means such as data memory, data processors, inputs from sensors to receive data from, for example, measurements such as the position and/or speed of the mandrel and outputs for control systems to control the speed and/or similar of the mandrel that enable the apparatus to control the speed of propulsion of the mandrel 3 at different speeds.

It is naturally understood that the mandrel 3 in embodiments may be driven with more than two predefined different speeds such as e.g. three different predefined speeds, four predefined different speed or even more different predefined speeds.

A computer program product designed for installation to control the apparatus 1 could thus allow the mandrel 3 to be driven at different predefined speeds such as V1 and V2 stated above. This computer program product may thus, for example, be installed in a new apparatus 1 or possibly be installed in an existing apparatus 1 as a software update to achieve propulsion of the mandrel 3 at different speeds.

A non-limiting example could be that the computer program product comprises a PLC (Programmable Logical Computer) program and that the apparatus 1 thus comprises a PLC installed in a suitable manner to perform instructions specified in the program. Note, of course, that the apparatus may comprise any conceivable suitable computer-based control system which, when the computer program product is installed in the control system, is able to control the apparatus according to the instructions in the computer program to control the mandrel at the different speeds.

FIG. 7 shows an example of an area AR1 on a fur that the apparatus is particularly designed also to scrape adequately via one or more of the above embodiments, comprising several scraper rollers 4*a*, 4*b*, 5*a*, 5*b*, 8*a*, 8*b*, 9*a*, 9*b* in a scraper unit 4, 5, 8, 9, via damper device(s) 16 and/or via one or more predefined speeds of the mandrel 3. The area in the figure shows a section of a fur, preferably a fur from a mink, with skin parts 2*a*, 2*b* that have enclosed a leg of the mink. Particularly behind and/or below and around this skin part 2*a*, 2*b*, there may be residues 17 of fat, tendons and/or flesh that are particularly difficult to remove but may be removed advantageously with an apparatus 1 in accordance with the present invention.

Of course, it is clear that various changes and modifications may be made to the embodiments shown in the drawings without departing from the invention as described in this document. Non-limiting examples may, for example, be that a scraper unit comprises one, two, three, four or even more scraper rollers, that the apparatus 1 may comprise the use of one scraper roller in a scraper unit with one or more damper arrangements and/or speed variations of the mandrel 3, that several scraper rollers are used in a scraper unit with one or more damper arrangements and/or speed variations of the mandrel 3, that a control system in the apparatus can adjust the rotational speed of the scraper rollers to one or more predefined speeds, and/or similar.

LIST

1: Apparatus for processing the skin side of a tubular fur.
2: Tubular fur.
2*a*, 2*b*: Skin parts that have covered a furred animal's legs.
3: Mandrel with tapered end.
3*a*: First part of the mandrel that is thinner than a second part of the mandrel.
3*b*: Second part of the mandrel.
4, 5: Scraper arrangements, for example scraper arrangements arranged vertically.
4*a*, 4*b*: Scraper rollers in a first scraper element.
5*a*, 5*b*: Scraper rollers in a second scraper element.
6: Scraper elements on scraper rollers.
7: Drive unit to drive scraper rollers.
8, 9: Scraper elements with scraper rollers arranged horizontally.
8*a*, 8*b*,
9*a*, 9*b*: Scraper rollers arranged horizontally.
10: Frame of the apparatus.
11*a*: End surfaces of scraper rollers.
11*b*: Continuous surface of scraper roller.
11*c*: Axial drilled hole in a scraper roller to accept a drive shaft.
12: Pressure arrangement to apply contact pressure to the fur.
13: Belt drive or chain drive to drive scraper rollers in a scraper unit.
14: Case for belt drive or chain drive.
15: Guide elements on guide arrangement.
16: Damper arrangement.
17: Residues of fat, tendons and/or flesh below and/or behind skin part.

The invention claimed is:

1. An apparatus for processing the skin side of a tubular fur, which apparatus comprises:

a tapering mandrel with a first part that is thinner than a second part of the mandrel, on which mandrel the tubular fur can be drawn from the first part of the mandrel towards the second part of the mandrel so that the skin side of the fur faces outwards and the fur side of the fur faces inwards towards the mandrel, at least a first scraper unit and a second scraper unit, each scraper unit comprising at least a first scraper roller which, during operation and in contact with the skin side, is arranged to rotate so that scraping elements on the scraper roller scrape the skin side of the fur on opposite sides of the mandrel, where the mandrel and the scraper units are arranged to be moved in relation to each other in the longitudinal direction of the mandrel, where the scraper units are arranged to be movable towards and away from the mandrel and comprise a pressure arrangement arranged to apply to said at least one scraper roller a contact pressure against the skin side, where the apparatus comprises a damper arrangement for damping the movement of the scraper units away from the mandrel, and wherein said damper arrangement is separate from said pressure arrangement.

2. An apparatus according to claim 1, where the damper arrangement comprises one or more linear shock absorbers.

3. An apparatus according to claim 1, where the damper arrangement comprises one or more shock-absorbing means arranged to absorb shock impacts in the horizontal plane towards and/or away from the mandrel.

4. An apparatus according to claim 1, where said scraper units furthermore each comprises a second scraper roller, where the first scraper rollers and the second scraper rollers are arranged behind each other in the longitudinal direction of the mandrel.

5. An apparatus according to claim 4, wherein said scraper rollers of said scraper units are arranged to act on the skin side with a friction force in the direction towards the second part of the mandrel.

6. An apparatus according to claim 1, where at least one of the scraper rollers of each scraper unit comprises one or more substantially V-shaped scraper elements.

7. An apparatus according to claim 1, where said mandrel is arranged to be driven at different predefined speeds, comprising at least a first predefined speed and a second predefined speed, where the first predefined speed is lower than the second predefined speed, and where the apparatus is arranged to switch between the first predefined speed and the second predefined speed when the fur on the mandrel is in different predefined positions.

8. An apparatus according to claim 7, where the mandrel is arranged to be driven at the first speed in and/or around areas on the fur that are, or may be, covered by skin parts that have covered the furred animal's legs.

9. An apparatus according to claim 7, where said mandrel is arranged to be driven with the second predefined speed after areas on the fur that are, or may be, covered by skin parts that have covered the furred animal's legs have been processed.

10. An apparatus for processing the skin side of a tubular fur, which apparatus comprises:

a tapering mandrel with a first part that is thinner than a second part of the mandrel, on which mandrel the tubular fur can be drawn from the first part of the mandrel towards the second part of the mandrel so that the skin side of the fur faces outwards and the fur side of the fur faces inwards towards the mandrel, at least a first scraper unit and a second scraper unit arranged on opposite sides of the mandrel where each of said first and second scraper unit comprises scraping means in the form of at least a first scraper roller and a second scraper roller that are arranged behind each other in the longitudinal direction of the mandrel and are designed, during operation and in contact with the skin side, to rotate so that scraper elements on the scraper rollers scrape the skin side of the fur, where the mandrel and the scraper units are arranged to be moved in relation to each other in the longitudinal direction of the mandrel, wherein the scraper rollers of said first and second scraper units during operation and in contact with the skin side, are arranged to act on the skin side with a friction force in the direction towards the second part of the mandrel, where at least one of the scraper rollers of each of said scraper units comprises one or more essentially V-shaped scraper elements.

11. An apparatus according to claim 10, where the scraper rollers in a scraper unit are arranged to be driven by the same drive unit.

12. An apparatus according to claim 10, where the scraper rollers in a scraper unit are arranged to be driven by means of the same belt drive or chain drive.

13. An apparatus according to claim 10, where at least two scraper rollers in a scraper unit have different characteristics.

14. An apparatus according to claim 13, where the different characteristics comprise at least that one scraper roller in a scraper unit, during operation, is arranged to rotate at a speed that is higher than another scraper roller in the same scraper unit.

15. An apparatus according to claim 13, where the different characteristics comprise at least that one scraper roller in a scraper unit has a diameter that is larger than the diameter of another scraper roller in the same scraper unit.

16. An apparatus according claim 10, where the scraper rollers of a scraper unit, during operation, are arranged to rotate around an essentially vertical axis to scrape the skin side arranged on side parts of the mandrel.

17. An apparatus according to claim 10, where the apparatus comprises two additional scraper units arranged, during operation, to apply a force to the skin side from opposite sides of the mandrel in a direction towards the second part of the mandrel, where each of the additional scraper units comprises at least two scraper rollers which, during rotation, are arranged to rotate in the same direction of rotation, where at least one of the scraper rollers in each scraper unit comprises one or more essentially V-shaped scraper elements, and where the additional scraper units, during operation, are arranged to rotate around an essentially horizontal axis in order thus to scrape at least one part of the fur that is not or will not be processed by the first scraper unit or second scraper unit.

18. An apparatus according to claim 1, wherein said apparatus further includes two additional scraper units, each of the scraper units having at least one scraper roller, wherein the two additional scraper units are arranged such that they, during operation of said apparatus, apply a force to the skin side from opposite sides of the mandrel in a direction towards the second part of the mandrel, wherein each of the at least one scraper roller of the additional scraper units are arranged to rotate around an essentially horizontal axis during operation of the apparatus to scrape at least one part of the fur that is not processed by the first scraper unit or the second scraper unit.

19. An apparatus according to claim 18, wherein said apparatus further includes a damper arrangement configured for damping shock impacts on the one or more scraper rollers of the additional scraper units.

20. An apparatus according to claim 18, wherein the additional scraper units are arranged to scrape the skin covering the upper surface parts and the lower surface parts of the mandrel, wherein the upper and lower surface parts are different from opposite side parts of the mandrel for being covered by the skin to be processed by said scraper rollers of the first scraper unit and the second scraper unit.

21. An apparatus according to claim 10, wherein the apparatus further includes two additional scraper units, each of the scraper units having at least one scraper roller, wherein the additional scraper units are arranged such that they, during operation of said apparatus, apply a force to the skin side from opposite sides of the mandrel in a direction towards the second part of the mandrel, wherein each of the at least one scraper roller of the additional scraper units are arranged to rotate around an essentially horizontal axis during operation of the apparatus to scrape at least one part of the fur that is not processed by the first scraper unit or the second scraper unit.

22. An apparatus according to claim 21, wherein the additional scraper units are arranged to scrape the skin covering the upper surface parts and the lower surface parts of the mandrel, wherein the upper and lower surface parts are different from opposite side parts of the mandrel for being covered by the skin to be processed by said scraper rollers of the first scraper unit and the second scraper unit.

23. An apparatus according to claim 10, wherein the mandrel is configured for moving in its longitudinal direction.

24. An apparatus according to claim 10, where scraper rollers of a scraper unit are configured for driving by separate drive units.

25. An apparatus according to claim 11, wherein said drive unit is an electric motor.

* * * * *